US005657198A

United States Patent [19]

Flener

[11] Patent Number: 5,657,198

[45] Date of Patent: Aug. 12, 1997

[54] CANISTER FOR SURFACE MOUNT ELECTRONIC COMPONENTS

[76] Inventor: Jeff M. Flener, 456 N. Yucca Cir., Mesa, Ariz. 85201

[21] Appl. No.: 540,801

[22] Filed: Oct. 11, 1995

[51] Int. Cl.[6] ..... H05F 3/02

[52] U.S. Cl. ..... 361/220; 361/212

[58] Field of Search ..... 361/212, 220; 206/445, 499; 221/155, 281

[56] References Cited

U.S. PATENT DOCUMENTS

| | | | |
|---|---|---|---|
| 663,290 | 12/1900 | Miller . | |
| 1,365,659 | 1/1921 | Carter | 206/408 |
| 1,438,135 | 12/1922 | Pettit . | |
| 2,242,933 | 5/1941 | Wagner | 133/1 |
| 3,263,860 | 8/1966 | Haas | 221/274 |
| 3,558,007 | 1/1971 | Seghezzi et al. | 229/93 |
| 4,346,817 | 8/1982 | Karcher | 221/312 R |
| 4,359,157 | 11/1982 | Horstmann | 206/328 |
| 4,998,685 | 3/1991 | Spencer | 242/137 |
| 5,042,687 | 8/1991 | McKinley | 221/321 |
| 5,425,474 | 6/1995 | Dalea et al. | 221/305 |
| 5,494,168 | 2/1996 | Hart | 206/714 |

*Primary Examiner*—Fritz Fleming
*Attorney, Agent, or Firm*—A. Donald Messenheimer; Steven Lin

[57] ABSTRACT

A canister for holding at least ten of reels of surface mount electrical or electronic components in a manner so that the reels can be removed individually through a slot located at the bottom of the stack of reels. The slot is preferably positioned and a recess provided so that a finger can be inserted under the lower surface of the lowermost reel without tilting the canister. The canister may be provided with an upper horizontal slot for insertion of reels one at a time and molded of a semiconductive plastics material that is opaque or alternatively stamped and rolled from sheet material such as aluminum or steel and coated with an anti-static paint. A vertical slot facilitates vertical sliding movement of a reel within the canister and provides visual access to easily determine the number of reels remaining for inventory control.

16 Claims, 1 Drawing Sheet

CANISTER FOR SURFACE MOUNT ELECTRONIC COMPONENTS

BACKGROUND

Many different types of electrical equipment are being made with electronic surface mount components such as are disclosed in U.S. Pat. No. 4,568,416 to Okui et at. These components are delivered to users attached to a strip like tape that is spirally wrapped around the hub of a reel that traditionally has a diameter of seven or twelve inches. Computer controlled machines are used to position such surface mount components on printed circuit boards without human handling of the components. It is not unusual to use hundreds of resistors, capacitors, inductors or other electrical components of different kinds and sizes by a single machine used in making a printed circuit board of a particular design. Most of the different components that are needed for a particular printed circuit board are brought to the positioning machine on a reel.

The number of reels remaining in inventory must be accurately determined and the inventory maintained at an appropriate level to prevent interruptions in the operation of the production line. A current practice is to store reels side by side on racks or tables. Monitoring the inventory on hand is a critical and a labor intensive process because the surface mount components cannot be visually identified except through use of bar codes that are customarily attached to the reels. In the event of an incident causing the reels to get mixed up, a major effort can be required to properly reposition the reels in inventory.

SUMMARY OF THE INVENTION

It is an object of this invention to provide a novel canister for holding a large number of reels of identical surface mount components in such a manner that the reels can be dispensed or removed one at a time on an as needed basis and the stack replenished on a regular basis to reduce the likelihood that the supply of any particular electrical component will become exhausted.

Another object is to provide a novel canister that is sized to hold a vertical stack of at least 10 reels and preferably more, on a canister base upper surface that is supported about a half inch or so above the bottom of the canister. This allows individual removeability of the reels on a first in, first out basis. Visibility of the reels remaining in the canister is provided so that the number of reels needed for replenishment is readily ascertainable.

A removable cover is provided to make canister loading easy and optionally a horizontal slot at the upper end may be provided for loading the canister, one reel at a time. A lower horizontal reel removal slot at the upper surface of the base is notched to facilitate insertion of a finger under the lowest reel in the stack to assist in removal of the lowermost reel from the stack in the canister.

A vertical transparent window along the side of which numbers are provided, can advantageously serve to indicate the number of reels remaining in the canister to facilitate inventory control. In a preferred embodiment the transparent window is a vertical slot having a width sufficient to allow the index finger and thumb to control movement of a reel vertically above the stack.

These and other objects and advantages will become apparent from the claims, and from a perusal of the description as it proceeds in conjunction with the appended drawings.

DETAILED DESCRIPTION OF PREFERRED EMBODIMENT

Figure 1:
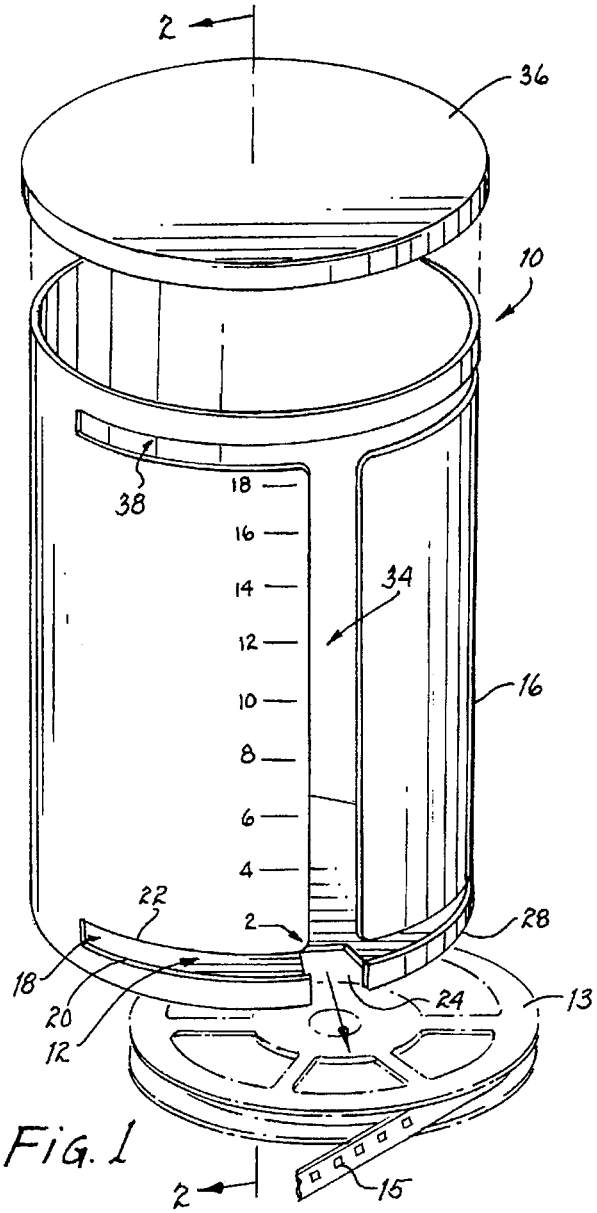
FIG. 1 is a pictorial view showing the front side of a canister according to the present invention showing removal of a reel.
Figure 2:
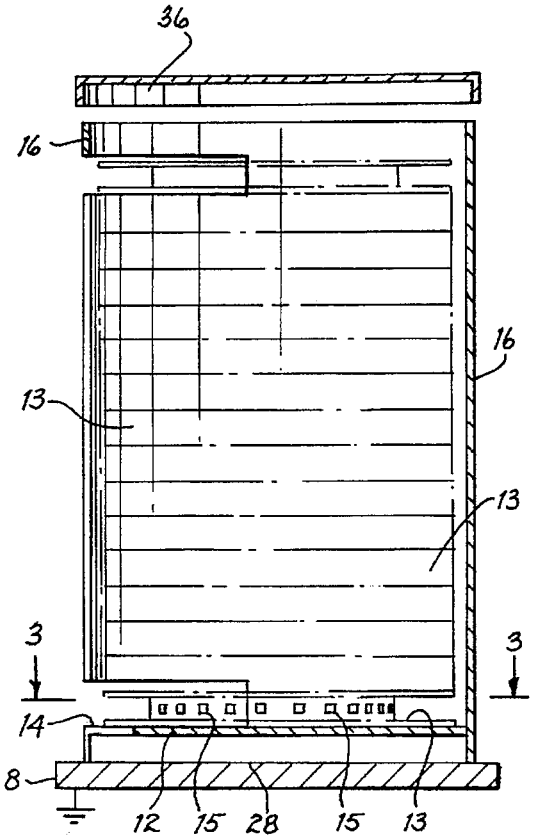
FIG. 2 is a side elevation in section of the canister taken along line 2—2 of FIG. 1 showing in phantom lines a stack of reels positioned in the canister.
Figure 3:
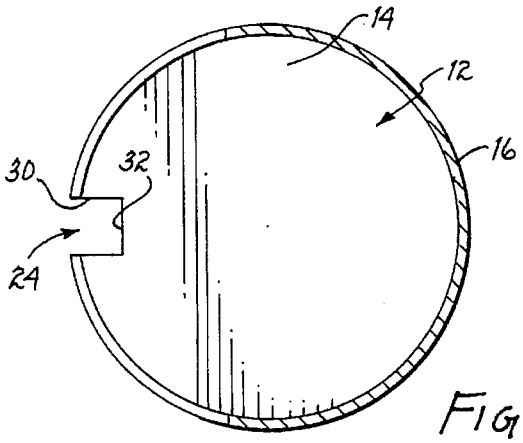
FIG. 3 is a plan view in section taken along line 3—3 of FIG. 2.
Figure 4:
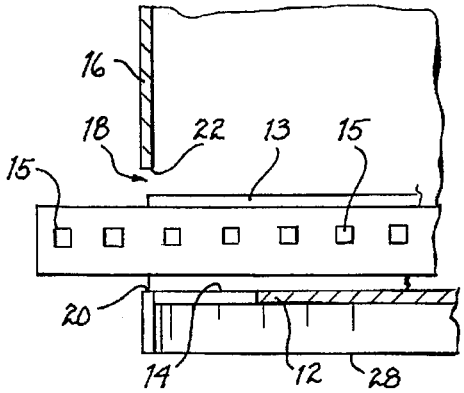
FIG. 4 is an enlarged view of the lower left portion of FIG. 2.

With reference to the drawings, the canister 10 has a lower base 12 that is sufficiently thick to provide rigidity and have a shape and size to provide stability when placed on an electrically grounded table or other supporting surface 8. The interior size is preferably matched to the dimensions of the reels 13, one of which is shown being removed from the canister 10 in FIG. 1. Reels 13 currently have diameters of either about 7 or about 12 inches and carry strips to which electrical components 15 are adherred. The height of the canister should be sufficient to hold a stack of at least 10 reels, and preferably 18 or more. As the reels have a thickness between outer surfaces of at least about one-half inch, the canister height is preferably a foot or more.

The base 12 has an upper horizontal surface 14 upon which the reels 13 rest. The upwardly extending sidewall 16 encircles and is secured to the base 12. The sidewall 16 has a lower slot 18 which extends essentially one-half the distance around the sidewall to provide a horizontal opening that is at least as large of the diameter of a reel 13. The lower slot 18 has an upper edge 22 and a lower edge 20. The lower edge 20 is at the base upper surface 14 and the upper edge 22 is spaced upwardly by somewhat more than the thickness of a reel 13 but less than the thickness of two reels whereby only the lowermost reel 26 can be removed through the lower slot 18. If desired, the lower slot edge 20 may be located upwardly by a slight amount above the upper surface 14 of the base 12 thereby to form a ledge to reduce the likelihood that a reel can inadvertently slide through the lower slot 18.

The lower slot edge 20 has a downwardly extending recess or notch 24, the depth of which provides an opening which will allow a finger to grasp the lower surface of the lowermost reel 26 in the stack without having to tilt the canister 10. When term finger is used herein, the thumb is included. The recess 24 extends radially inwardly by a distance sufficient to allow the insertion of a person's finger under the bottom surface of the lowermost reel 26 to allow removal of the reels one at a time. In the embodiment illustrated, the sidewall 16 and the base 12 are cut from sheet material. The sidewall is rolled to an appropriate diameter and the base 12 secured, such as by welding, in place at a position above the lower end 28 of the sidewall. The recess 24, may be formed by a saw cut that extends downwardly to the lower end of the sidewall at 30 and radially into the base at 32 for a distance of about a half inch. The upper surface 14 of the base 12 is preferably located up about a half inch or so from the lowermost edge 28 of sidewall 16 to allow space for the insertion of a finger when grasping the lowermost reel for removal without tilting the canister 10.

It is important to be able from time to time to quickly determine how many reels are in the canister. Each canister is dedicated to only one type and size of electrical component at a time. A typical manufacturing operation may use more than 50 different surface mount electrical components for a particular production line. Periodic replenishment of reels as they are used may occur each day and inventory as used may be replaced over night. As the walls of the canister are opaque, a transparent section or window is helpful when determining how many reels remain in the canister. Without inserting transparent material, I prefer to use a vertical slot 34 that extends upwardly from the upper edge 22 of the lower slot 20 so that the position of the uppermost reel in the stack can be observed. Calibration markings with numbers along the side of the slot simplify the matter of accurately checking inventory. The importance of inventory checks cannot be over stated since the inadvertent exhaustion of the supply of any one electrical component can result in the total shut-down of product flow through the production line. While index markings as illustrated in FIG. 1 may be applied to a surface at the time of manufacture, the widths of the so-called standard sized reels vary somewhat which means that calibration markings may be better provided on decals which can be applied or replaced by the end user along the side of vertical slot 34.

The vertical slot 34 also serves to allow a thumb and finger to reach through to grasp the edge of a reel to assist with lifting or lowering a reel that may have become tilted. When it is desired to insert a reel without removing the cover 36, an upper horizontal slot 38 may be provided. The upper slot 38 is preferably the same size and shape as the lower slot 20 and conveniently located in vertical alignment above the lower slot.

Loading of reels into the canister is normally through the open top end of the encircling sidewall. For easy loading of an empty canister with a large number of reels one at a time, the reels may be carefully stacked and the canister up-ended over the stack. Thereafter a lid or cover 36 may be applied. The cover 36 should have a snug fit such as by friction, or be snapped, threaded or otherwise held in place on the sidewall 16 so that in the event of a canister upset, the reels will not fall out. This is particularly important where a number of canisters each having different electrical components are accidentally upset and the reels mixed. The specific choice of fit may be influenced by the material from which the canister is made.

Because surface mount components of the type supplied on reels are sensitive to electrostatic charges that build up during normal handling, any synthetic resin or plastics material that is used for molding my new canister must have a small amount of electrical conductivity. Plastic reels on which the tapes carrying the surface mount electrical components are mounted, are already made of a suitable material. Carbon black is commonly mixed with the plastic material to be molded thereby making the canister walls opaque. Alternatively, I have made canisters from both aluminum and steel flat plate that can be stamped and rolled. Conductive paint that is commercially available may be used on the metal surfaces to dissipate electrostatic charge that is dangerous to the surface mount components. It is important that the canister be electrically grounded to avoid electrostatic charge build up that can damage surface mount components.

While my preferred constructions have been discussed in detail, it is apparent that changes and modifications may be made without departing form the spirit of the present invention. All changes and modifications which come within the scope of the claims are intended to be covered thereby.

What is claimed is:

1. In combination, a canister containing a stack of reels of substantially the same diameter with each reel having substantially flat parallel spaced surfaces on opposite ends of a central hub upon which is wound a strip shaped tape carrying surface mount electrical components adapted to be mounted on a printed circuit board, said canister comprising:

a base member having an upper surface sized and shaped to support said reel stack;

an encircling wall surrounding the base member to serve as a sidewall and extending upwardly from said base upper surface for a distance sufficient to hold at least ten of said reels when positioned on said upper surface with said parallel surfaces horizontally disposed on each other in the form of a stack;

said encircling wall having a first slot extending laterally around approximately one half of the sidewall and having parallel upper and lower edges, said lower edge of said slot being substantially parallel with said base upper surface, said upper edge being spaced above the lower edge by a distance sufficient to allow removal of said reels one only at a time from the bottom of the stack; and wherein the canister has sufficient conductivity to dissipate any electrostatic charge when resting on an electrically grounded support that is detrimental to the electrical components carried by said reels.

2. The combination of claim 1 further having a cover member removably attached to an upper end of said encircling wall to allow loading of the canister when the cover is removed with the reels already in the form of a stack by up-ending the canister to fit over the stack of reels and thereafter returning the canister to its upright position.

3. The combination of claim 1 wherein said encircling wall is opaque and has a transparent portion through which the number of reels present in the reel stack can be observed.

4. The combination of claim 3 wherein the transparent portion comprises a second generally vertical slot extending upwardly from the upper edge of said first slot to a position near the top of said encircling wall, the width of said second slot being sufficient to receive a finger which can engage one of said reels in said stack to assist in lifting and lowering said one reel.

5. The combination of claim 4 wherein said encircling wall has a third slot positioned at the top of said vertical slot; said third slot being parallel to and in substantial vertical alignment with said first slot; and said third slot being of substantially the same size and shape as said first slot to allow introduction of reels into said canister one at a time through said third slot.

6. The combination of claim 5 wherein said sidewall supports the upper surface of said base at a position above a lower edge of said sidewall that is sufficient to allow a finger to extend under a reel resting on the base upper surface, said sidewall and said base having a recess extending inwardly and being of a size to receive a finger to engage a bottom surface of the lowermost reel in said stack to assist with removal of said lowermost reel from said canister.

7. The combination of claim 6 wherein the recess comprises a slot which extends from the lower edge of the first slot down through the lower edge of the sidewall to provide an inverted U-shaped finger receiving opening in the sidewall.

8. The combination of claim 1 wherein said base has a recess extending radially inwardly with a width sufficient to receive a finger to engage a bottom surface of the lowermost reel in said stack to assist with removal of said lowermost reel from said canister.

9. The combination of claim 8 wherein the base is supported above the lower edge of said sidewall by a distance sufficient to a receive a finger through said recess and under the bottom surface of the lowermost reel without tilting the canister.

10. A free standing canister for supporting a stack of reels carrying surface mount electrical components comprising:

a generally cylindrical sidewall adapted to rest on a support surface and having a height sufficient to hold at least ten of said reels when the reels are positioned with flat surfaces on each other to form a vertical stack of reels within the canister, said sidewall having a first substantially horizontal slot having essentially parallel upper and lower parallel edges extending laterally around approximately one half of the sidewall with a lower edge of said slot being above a lower end of the sidewall;

a rigid base member supported around its periphery at a lower portion of said sidewall and having an upper surface adapted to support a lower reel side surface in substantial horizontal alignment with the lower edge of said slot, said upper edge of said slot being spaced above the lower edge by a distance sufficient to allow removal of said reels one only at a time from the bottom of the stack;

said sidewall and said base being formed to have a recess extending inwardly and downwardly from the lower edge of the lower slot, said recess being of a size to allow insertion of at least one finger under a lower surface of a bottom reel from said stack.

11. The canister of claim 10 further having a cover sized to fit on an upper open end of said sidewall, said cover being removable from the upper end of said sidewall to permit simultaneous loading of multiple reels in said canister.

12. The canister of claim 10 further having a transparent portion in said sidewall through which the height of the reel stack can be observed and a decal with markings indicating the number of reels within the canister.

13. The canister of claim 10 further comprising a second upper slot similar in size and shape to said first slot with an upper edge that is spaced near the upper edge of said sidewall to allow insertion of reels one at a time, and a vertical slot extending between the first and second slots, said vertical slot having a width sufficient to receive a finger to assist in raising and lowering a reel in the canister.

14. In combination, a canister including a base having a substantially horizontal upper surface;

an encircling wall surrounding the base, supporting the base upper surface about a half inch above a lower support surface of said encircling wall, and extending upwardly from said base upper surface;

said encircling wall having a slot extending laterally around approximately one half of the sidewall and having parallel upper and lower edges, said lower slot edge being substantially parallel with said base upper surface and said upper edge being spaced above the lower edge by a predetermined distance;

a stack of reels having outer diameters of substantially equal size with each reel having substantially flat, parallel outer surfaces on opposite ends of a central hub, said outer surfaces being spaced apart by a second distance no greater than said predetermined distance between said upper and lower edges of said canister slot;

a strip of material carrying surface mount electrical components, said strip being spiral wrapped around said hub and between the outer surfaces; and said stack of reels being mounted within said canister on said base upper surface with the lowermost reel being accessible through said slot for manual removal from said canister one at a time without tilting the canister.

15. The combination of claim 14 further having a cover member removably attached to an upper end of said encircling wall to allow simultaneous loading of multiple reels in the canister when the cover is removed.

16. The combination of claim 14 further having a continuous opening in the base which extends from the lower edge of said slot to a location about a half inch radially inwardly from the sidewall and to said lower supporting edge of the sidewall, said opening being of a size to allow a finger to be inserted and engage the lower surface of the lowermost reel in the canister.

* * * * *